US010859051B2

(12) United States Patent
Perry

(10) Patent No.: US 10,859,051 B2
(45) Date of Patent: Dec. 8, 2020

(54) FUEL INJECTOR WITH COMBINED CALIBRATION TUBE, FUEL FILTER, AND PRESSURE PULSATION DAMPING ORIFICE

(71) Applicant: DELPHI TECHNOLOGIES IP LIMITED, St. Michael (BB)

(72) Inventor: Robert B. Perry, Leicester, NY (US)

(73) Assignee: DELPHI TECHNOLOGIES IP LIMITED

( * ) Notice: Subject to any disclaimer, the term of this patent is extended or adjusted under 35 U.S.C. 154(b) by 149 days.

(21) Appl. No.: 16/006,176

(22) Filed: Jun. 12, 2018

(65) Prior Publication Data

US 2019/0376480 A1 Dec. 12, 2019

(51) Int. Cl.
*F02M 61/20* (2006.01)
*F02M 61/16* (2006.01)

(52) U.S. Cl.
CPC ..... *F02M 61/205* (2013.01); *F02M 61/165* (2013.01); *F02M 2200/315* (2013.01); *F02M 2200/8092* (2013.01)

(58) Field of Classification Search
CPC ..... F02M 61/205; F02M 61/165; F02M 2200/315; F02M 2200/8092; F02M 2200/28; F02M 2200/505; F02M 61/168; F02M 55/04
USPC ..... 239/575, 533.2, 533.3, 533.4, 533.6, 239/533.7, 533.9, 533.11, 533.12, 585.1, 239/585.2, 585.3
See application file for complete search history.

(56) References Cited

U.S. PATENT DOCUMENTS

| | | | |
|---|---|---|---|
| 4,218,021 | A | 8/1980 | Palma |
| 5,340,032 | A | 8/1994 | Stegmaier et al. |
| 5,494,224 | A | 2/1996 | Hall et al. |
| 5,755,386 | A | 5/1998 | Lavan et al. |
| 5,921,475 | A | 7/1999 | DeVriese et al. |
| 5,937,887 | A | 8/1999 | Baxter et al. |
| 5,979,866 | A | 11/1999 | Baxter et al. |
| 6,019,128 | A | 2/2000 | Reiter |
| 6,328,232 | B1 | 12/2001 | Haltiner et al. |
| 6,648,247 | B2 | 11/2003 | McFarland |

(Continued)

FOREIGN PATENT DOCUMENTS

| | | | |
|---|---|---|---|
| DE | 102014226003 | A1 | 6/2016 |
| DE | 102015226528 | A1 | 6/2017 |

(Continued)

*Primary Examiner* — Qingzhang Zhou
(74) *Attorney, Agent, or Firm* — Joshua M. Haines

(57) ABSTRACT

A fuel injector with inlet and discharge ends includes a fuel tube through which fuel is admitted to a fuel passage extending to the discharge end. A valve element reciprocates against and away from a valve seat to prevent or allow fuel discharge. A calibration tube includes first and second ends and defines a portion of the fuel passage through which fuel must pass to the discharge end, the second end defining a spring seat engaging a spring and biasing the spring against the valve element. A fuel filter filters all fuel passing to the discharge end, and provides restriction of a first magnitude. The calibration tube includes a pressure pulsation damping orifice fluidly between the fuel filter and the discharge end through which fuel must pass to the discharge end, the pressure pulsation damping orifice provides restriction of a second magnitude which is greater than the first magnitude.

2 Claims, 4 Drawing Sheets

(56) References Cited

U.S. PATENT DOCUMENTS

| | | | | |
|---|---|---|---|---|
| 2003/0052052 | A1 | 3/2003 | Boast et al. | |
| 2010/0213286 | A1 * | 8/2010 | Grandi ..... | F02M 51/061<br>239/575 |

FOREIGN PATENT DOCUMENTS

| | | | |
|---|---|---|---|
| GB | 295864 | * | 8/1928 |
| JP | 2002130088 | A | 5/2002 |

* cited by examiner

FUEL INJECTOR WITH COMBINED CALIBRATION TUBE, FUEL FILTER, AND PRESSURE PULSATION DAMPING ORIFICE

TECHNICAL FIELD OF INVENTION

The present invention relates to fuel injector for injecting fuel to a fuel consuming device; more particularly to such a fuel injector which includes a calibration assembly for setting the load on a biasing spring; and even more particularly to such a fuel injector where the calibration assembly includes a fuel filter fixed thereto and a pressure pulsation damping orifice.

BACKGROUND OF INVENTION

Fuel injectors are well known for precisely metering a desired amount of fuel to a fuel consuming device, for example, an internal combustion engine. In one known arrangement, electricity is applied to a solenoid to open a valve member of the fuel injector in order to inject fuel. Conversely, in order to stop injection, electricity to the solenoid is stopped and a biasing spring closes the valve member. In order to ensure proper closing characteristics of the valve member, a force applied to the valve member by the biasing spring must be adjusted during manufacture. This is commonly accomplished by a calibration tube against which the biasing spring acts. During manufacture, flow characteristics of the fuel injector are monitored and the position of the calibration tube is adjusted so as to affect the force of the biasing spring acting on the valve member. The position of the calibration tube is adjusted until the desired flow characteristics are achieved. One example of such a calibration tube is illustrated in U.S. Pat. No. 6,328,232 to Haltiner, Jr. et al. The calibration tube of Haltiner, Jr. et al. is provided in an assembly with a fuel filter which filters all fuel that passes through the fuel injector. While the arrangement of Haltiner, Jr. et al. may be effective, it may be desired in some fuel injectors to have a feature which dampens pressure pulsations that may be produced during operation of the fuel injector. It is also known to provide an orifice within the fuel injector which dampens the pressure pulsations, however, these orifices are commonly installed after calibration and are upstream of the fuel filter. Consequently, the final flow characteristics of the fuel injector may be altered after installation of the orifice, and furthermore, the orifice may be prone to plugging with contamination from the fuel since the orifice is upstream of the fuel filter.

What is needed is a fuel injector which minimizes or eliminates one or more the shortcomings as set forth above.

SUMMARY OF THE INVENTION

Briefly described, a fuel injector with an inlet end and a discharge end includes a fuel tube at the inlet end through which fuel is admitted to a fuel passage extending to the discharge end; a valve at the discharge end and having a valve element reciprocable against and away from a valve seat to prevent or allow fuel discharge through the valve seat; a calibration tube having a first end and a second end and defining a portion of the fuel passage through which fuel must pass to the discharge end, the second end defining a spring seat operatively engaging the biasing spring and biasing the biasing spring against the valve element with a set force which controls fuel discharge from the fuel injector, the calibration tube being adjustable within the fuel injector for calibrating the biasing spring to establish the set force; and a fuel filter which filters all fuel passing through the calibration tube to the discharge end, the fuel filter providing restriction of a first magnitude, the fuel filter being fixed to the calibration tube such that the fuel filter moves together with the calibration tube when the calibration tube is adjusted to calibrate the biasing spring. The calibration tube includes one or more pressure pulsation damping orifices fluidly between the fuel filter and the discharge end through which fuel must pass to the discharge end, the one or more pressure pulsation damping orifices collectively providing restriction of a second magnitude which is greater than the first magnitude. The fuel injector with the calibration tube and filter as described herein allows for accurate setting of flow characteristics of fuel injector and also provides for damping of pressure pulsations produced during operation of the fuel injector without being susceptible to plugging by contaminants within the fuel.

BRIEF DESCRIPTION OF DRAWINGS

This invention will be further described with reference to the accompanying drawings in which.

DETAILED DESCRIPTION OF INVENTION

Figure 1:
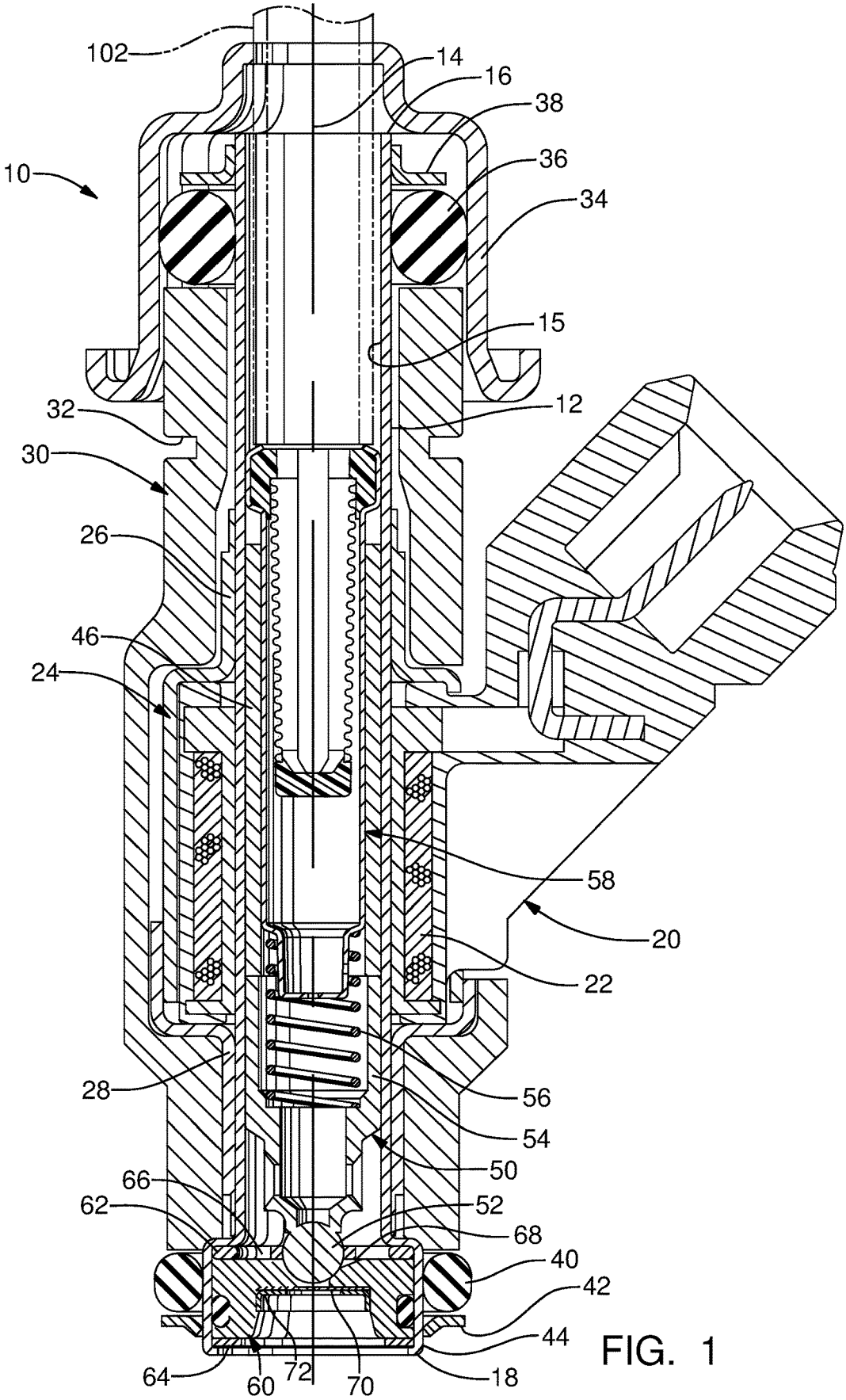
FIG. 1 is a cross-sectional view through a fuel injector in accordance with the present invention.

Referring first to FIG. 1 of the drawings in detail, a fuel injector 10 is illustrated in accordance with the present invention for injecting fuel to a fuel consuming device such as an internal combustion engine (not shown). As illustrated, fuel injector 10 may be a solenoid actuated fuel injector and may be a port fuel injector, as will be readily recognized by a practitioner of ordinary skill in the art, which injects fuel into an intake manifold of the internal combustion engine where the fuel is mixed with air to form an air and fuel mixture which is subsequently drawn into a combustion chamber of the internal combustion engine during an intake stroke. However, the fuel injector described herein is by way of non-limiting example only, and particularly may also be applied to a fuel injector which is used for injecting fuel directly into the combustion chamber of the internal combustion engine where the fuel is mixed with air within the combustion chamber to form an air and fuel mixture.

Fuel injector 10 includes a continuous fuel tube 12 which is centered on a central axis 14 and encloses a continuous fuel passage 15 through the injector from an inlet end 16 of fuel tube 12 tube to a discharge end 18. Preferably, fuel tube 12 has no openings except at inlet end 16 and discharge end 18 and defines a continuous imperforate passage in which fuel is conducted and kept separate from all the components of fuel injector 10 that are mounted externally of fuel tube 12. These include a coil assembly 20 having a solenoid coil 22 extending around and closely adjacent to fuel tube 12. A magnetic coil body 24 surrounds solenoid coil 22 and has an upper portion 26 and a lower portion 28 fixed to the outer surface of fuel tube 12.

A cover 30 is formed as a two-piece tubular member that is assembled over fuel tube 12 and surrounds magnetic coil body 24. Cover 30 includes a slot 32 for receiving a retainer clip, not shown, that holds inlet end 16 within a cup 34 of an associated fuel rail (not shown). Cover 30 also provides a backup surface for constraining a seal ring 36 of a conventional O-ring type. A push-on seal retainer 38 is frictionally or otherwise retained on inlet end 16 of fuel tube 12 to form with the other parts an annular groove in which seal ring 36 is retained. A lower end of cover 30 also backs up an O-ring seal 40 retained by a lower seal retainer 42 on an expanded diameter portion 44 at the lower end of fuel tube 12.

Within fuel tube 12, a tubular magnetic pole 46 is fixed in engagement with the interior surface of fuel tube 12. Magnetic pole 46 extends from adjacent upper portion 26 of magnetic coil body 24 to a position within the axial extent of solenoid coil 22. An injection valve 50 is reciprocable within the fuel tube 12 and includes a ball end 52 connected with a hollow armature 54 that slides within fuel tube 12. A biasing spring 56 engages an upper end of armature 54 and is compressed with a predetermined force by a calibration assembly 58 shown assembled in fuel injector 10 in FIG. 1 and shown separately in FIG. 2 to be subsequently further described.

Within the expanded diameter portion 44 of fuel tube 12, a valve seat 60 and a lower guide 62 are retained by crimped over portions of discharge end 18 which engage a seat washer 64. Lower guide 62 is a disc which guides ball end 52 of injection valve 50 and includes openings 66 that allow fuel flow through lower guide 62 to a conical surface 68 of valve seat 60 against which ball end 52 seats in a valve closed position. A central discharge opening of the valve seat 60 connects with a multi-hole spray director 70 held in a recess of valve seat 60 by a retainer 72.

To properly control the speed and efficiency of valve action in fuel injector 10, it is important that the valve stroke be set to a desired predetermined value. This may be accomplished by providing for adjusting the position of valve seat 60. However, in the present embodiment, the valve stroke is preferably set by making magnetic pole 46 axially adjustable within the fuel tube 12 to establish the desired clearance between magnetic pole 46 and armature 54 in the valve closed position. This is done by sliding magnetic pole 46 inside the fuel tube 12 to obtain the proper clearance, after which magnetic pole 46 may be fixed within fuel tube 12 by the friction developed from an interference fit or by crimping or otherwise securing the fuel tube 12 to magnetic pole 46 in the adjusted position.

Calibration assembly 58 includes a preferably metal calibration tube 74 to which a fuel filter 76 is fixed. The calibration tube 74 includes a generally tubular body 78 sized to be telescopically received within the magnetic pole 46 of fuel injector 10. At a lower end 80, tubular body 78 is stepped into a smaller diameter forming an annular seat 82 against which the biasing spring 56 is seated and an annular extending spring guide 84 which extends into biasing spring 56 for guiding the upper end thereof.

At its upper end 86, the tubular body 78 has a diametrically enlarged or expanded portion 88 which is sized to be an interference fit within fuel tube 12 where it is received toward inlet end 16 of fuel injector 10. Fuel filter 76 includes a plastic frame 90 having an enlarged annular base 92 connected by two or more longitudinal ribs 94 with a solid cap 96, forming a plurality of spaced windows through which fuel may pass. A tubular filter screen 98 is molded into plastic frame 90 and extends between annular base 92 and solid cap 96 alongside longitudinal ribs 94. Tubular filter screen 98 covers all the windows and requires fuel passing therethrough to pass through the tubular filter screen 98 to screen out solid particles of a desired size. In the present instance, particles carried in the fuel that are greater than 30 microns are separated out by the filter screen 98. Furthermore, fuel filter 76 provides a restriction of a first magnitude to fuel passing from inlet end 16 to discharge end 18.

Figure 2:
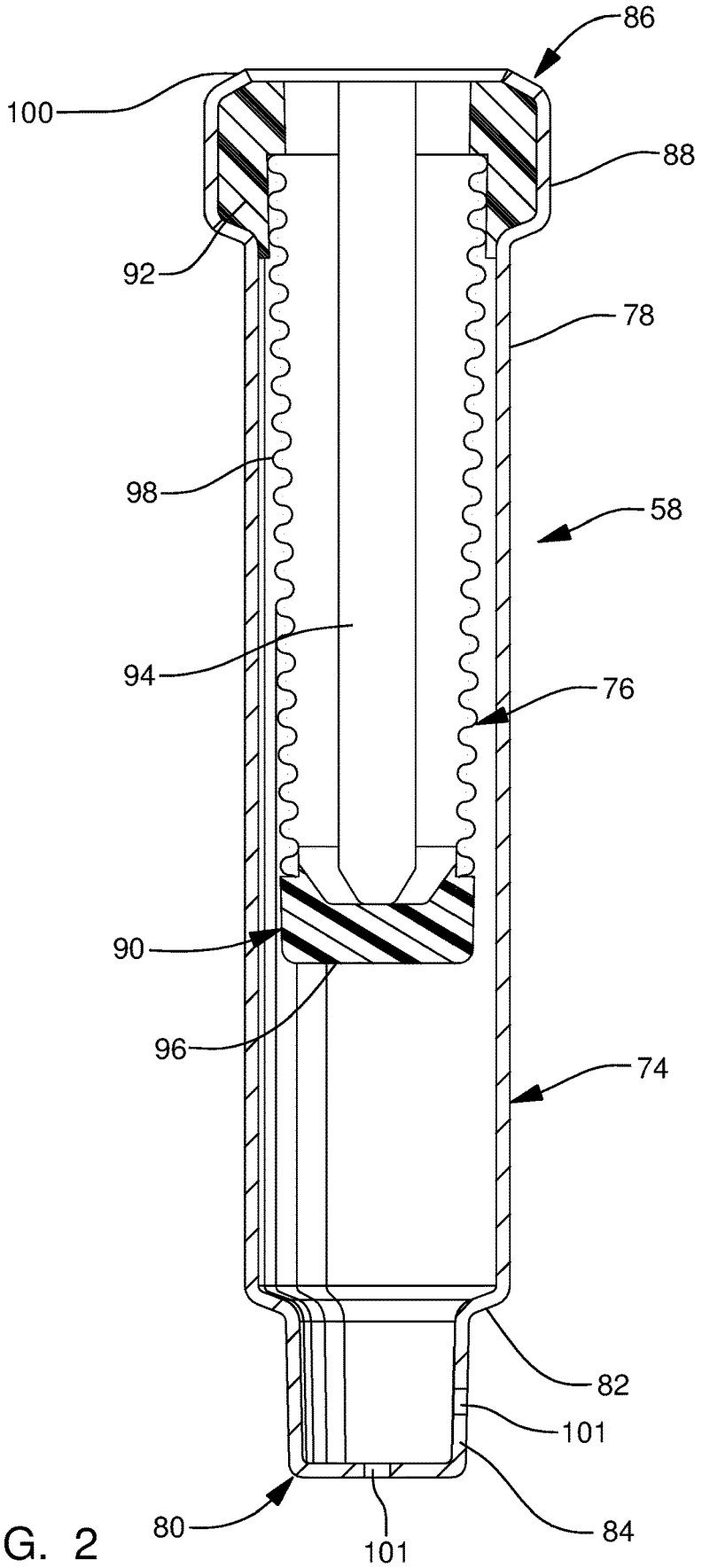
FIG. 2 are a cross-sectional view of a calibration tube, filter, and pulsation damping orifice of the fuel injector of FIG. 1.
Figure 3:
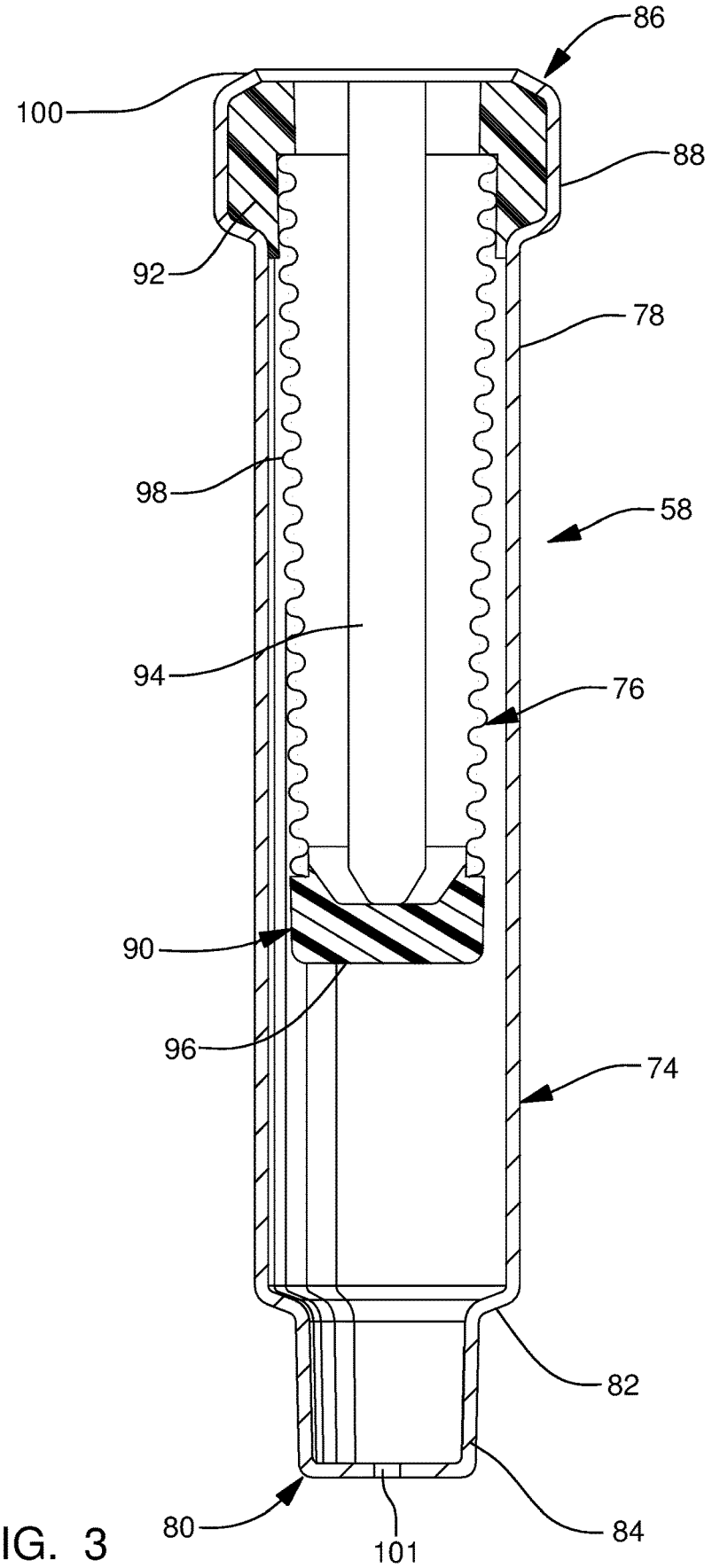
FIG. 3 is a cross-sectional view of another calibration tube, filter, and pulsation damping orifice of the fuel injector of FIG. 1.
Figure 4:
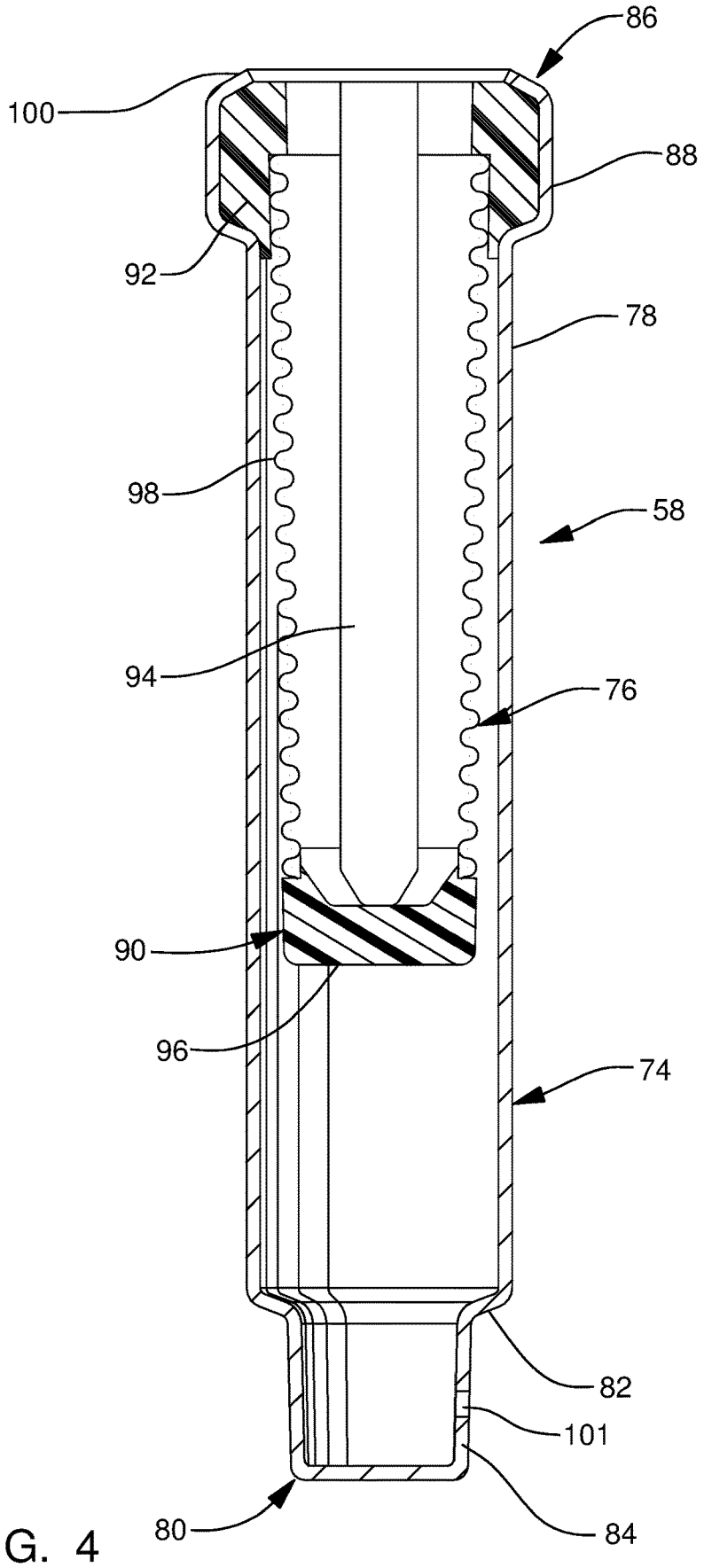
FIG. 4 is a cross-sectional view of another calibration tube, filter, and pulsation damping orifice of the fuel injector of FIG. 1.

Fuel filter 76 has annular base 92 fitted tightly within expanded portion 88 of tubular body 78, where upper end 86 is crimped or rolled over at 100 to fix fuel filter 76 tightly within the calibration tube 74. Fuel filter 76 is mounted so that filter screen 98 and solid cap 96 extend downward within tubular body 78 of the calibration tube 74. The design allows the free flow of fuel into the upper end 86 of calibration tube 74 and through the filter screen 98 and the interior of tubular body 78, passing out through calibration tube 74 through one or more pressure pulsation damping orifices 101 which are fluidly between fuel filter 76 and discharge end 18, i.e. downstream of fuel filter 76 and upstream of discharge end 18. All fuel that passes through fuel filter 76 subsequently must pass through one of pressure pulsation damping orifices 101 in order to reach discharge end 18. Furthermore, pressure pulsation damping orifices 101 collectively provide a restriction of a second magnitude which is greater than the restriction of the first magnitude provided by fuel filter 76/filter screen 98. The restriction of the second magnitude provided collectively by pressure pulsation damping orifices 101 being greater than the restriction of the first magnitude provided by fuel filter 76/filter screen 98 provides a pressure drop which aids in mitigating pressure pulsations which are produced during operation of fuel injector 10. While FIGS. 1 and 2 illustrate two pressure pulsation damping orifices 101, one pressure pulsation damping orifice 101 being provided axially through calibration tube 74 at lower end 80 and one pressure pulsation damping orifice 101 being provided radially through calibration tube 74, it should be understood that a greater number of pressure pulsation damping orifices 101 may be provided or that a single pressure pulsation damping orifice 101 may be provided as shown in FIGS. 3 and 4 where FIG. 3 includes only pressure pulsation damping orifice 101 at lower end 80. As shown in FIG. 4, pressure pulsation damping orifice 101 at lower end 80 from FIG. 3 may be omitted, and pressure pulsation damping orifice 101 which extends radially through calibration tube 74 may be provided as a single pressure pulsation damping orifice 101. In this alternative arrangement shown in FIG. 4, pressure pulsation damping orifice 101 is spaced axially from lower end 80 of calibration tube 74 such that a contamination trap may be formed within calibration tube 74 axially between lower end 80 and pressure pulsation damping orifice 101 where the contamination trap may serve to catch any contamination generated when fuel filter 76 is installed within calibration tube 74. Furthermore, the difference between the restriction of the second magnitude provided collectively by pressure pulsation damping orifices 101 and the restriction of the first magnitude provided by fuel filter 76/filter screen 98 may be tailored, for example by altering the restriction provided by pressure pulsation damping orifices 101, to dampen pressure pulsations in desired frequency ranges. This may be accomplished through empirical testing, for example, by providing a particular restriction of pressure pulsation damping orifices 101 and observing noise levels produced by pressure pulsations in operation of fuel injector 10.

As shown in FIG. 1, calibration assembly 58 is inserted into fuel tube 12 with expanded portion 88 at its upper end forced into inlet end 16 of fuel tube 12. The parts are sized for an interference fit forming a sufficient restriction to prevent any significant bypassing of fuel around fuel filter 76 within calibration tube 74. The interference fit is also adequate to prevent the passage of particles around fuel filter 76 which are greater than 30 microns which fuel filter 76 is designed to remove from the fuel passing therethrough. Lower end 80 of calibration tube 74 is positioned with annular seat 82 against biasing spring 56 and with spring guide 84 extending inside the upper end of biasing spring 56.

In order to calibrate biasing spring 56 to obtain the proper spring force against injection valve 50, a calibrating tool 102 is used as shown in phantom in FIG. 1. During assembly of fuel injector 10, before insertion into cup 34, calibrating tool 102 is inserted through inlet end 16 of fuel tube 12 into engagement with the crimped over portion 100 of calibration assembly 58 and a force, which can be as much as 40 to 80 pounds, is exerted which is adequate to slide calibration tube 74 downward against the biasing spring 56 until the desired spring force or fuel flow for fuel injector 10 is reached. It should be noted that since fuel filter 76 is fixed to calibration tube 74, fuel filter 76 moves together with calibration tube 74 when calibration tube 74 is adjusted to calibrate biasing spring 56. Calibrating tool 102 is then removed and calibration assembly 58 is retained in fixed position within fuel injector 10 by the substantial interference fit between expanded portion 88 of calibration tube 74 and the interior of fuel tube 12. If desired, tubular body 78 of calibration tube 74 could also be fitted with sufficient force into magnetic pole 46 to supplement the securing force applied to the calibration tube 74 within fuel tube 12.

Fuel injector 10 which includes calibration assembly 58 as described herein allows for fuel injector 10 to be completely assembled, including fuel filter 76 and pressure pulsation damping orifices 101, prior to setting the force on biasing spring 56. Consequently, the force set on biasing spring 56 can take into account the flow characteristics of fuel filter 76 and pressure pulsation damping orifices 101. Furthermore, pressure pulsation damping orifices 101 are provided with no additional components to provide pressure pulsation damping, and since pressure pulsation damping orifices 101 are provided fluidly between fuel filter 76 and discharge end 18, particles that are sufficiently large to block pressure pulsation damping orifices 101 are captured by fuel filter 76, thereby allowing for uninterrupted operation of fuel injector 10. It is important to note that calibration tube 74, fuel filter 76, and pressure pulsation damping orifices 101 are provided in a single assembly which is installed within fuel injector 10 prior to calibrating biasing spring 56.

While this invention has been described in terms of preferred embodiments thereof, it is not intended to be so limited, but rather only to the extent set forth in the claims that follow.

We claim:

1. A fuel injector having an inlet end and a discharge end, said fuel injector comprising:

a fuel tube at said inlet end through which fuel is admitted to a fuel passage extending to said discharge end;

a valve at said discharge end and having a valve element reciprocable against and away from a valve seat to prevent or allow fuel discharge through said valve seat;

a biasing spring having a first end operatively engaging said valve element;

a calibration tube having a first end and a second end and defining a portion of said fuel passage through which fuel must pass to said discharge end, said second end defining a spring seat operatively engaging said biasing spring and biasing said biasing spring against said valve element with a set force which controls fuel discharge from said fuel injector, said calibration tube being adjustable within said fuel injector for calibrating said biasing spring to establish said set force; and a fuel filter which filters all fuel passing through said calibration tube to said discharge end, said fuel filter providing restriction of a first magnitude, said fuel filter being fixed to said calibration tube such that said fuel filter moves together with said calibration tube when said calibration tube is adjusted to calibrate said biasing spring;

wherein said calibration tube includes one or more pressure pulsation damping orifices fluidly between said fuel filter and said discharge end through which fuel must pass to said discharge end, said one or more pressure pulsation damping orifices collectively providing restriction of a second magnitude which is greater than said first magnitude;

wherein said one or more pressure pulsation damping orifices is a single pressure pulsation damping orifice through which fuel must pass to said discharge end, said single pressure pulsation damping orifice providing restriction of said second magnitude which is greater than said first magnitude; and wherein said calibration tube extends along an axis from said first end of said calibration tube to said second end of said calibration tube and said single pressure pulsation damping orifice extends radially through said calibration tube.

2. A fuel injector as in claim 1, wherein said single pressure pulsation damping orifice is spaced axially from said second end of said calibration tube such that a contamination trap is formed within said calibration tube axially between said second end of said calibration tube and said single pressure pulsation damping orifice.

* * * * *